United States Patent [19]

Grayson et al.

[11] Patent Number: 4,922,724

[45] Date of Patent: May 8, 1990

[54] MARINE ICE MAKING AND DELIVERY SYSTEM

[76] Inventors: William Grayson, 9045 Hawthorne Ave., Surfside, Fla. 33154; Melvin E. Strahosky, 11919 NE. 8th Ave., North Miami, Fla. 33161

[21] Appl. No.: 322,187

[22] Filed: Mar. 13, 1989

[51] Int. Cl.[5] ..... B63B 25/26; F25C 5/18

[52] U.S. Cl. ..... 62/135; 62/201; 62/240; 62/330; 62/344

[58] Field of Search ..... 62/240, 330, 344, 354, 62/506, 135, 201

[56] References Cited

U.S. PATENT DOCUMENTS

| | | | |
|---|---|---|---|
| 2,057,101 | 10/1936 | Kagi | 62/201 X |
| 2,748,572 | 6/1956 | Parcaro | 62/506 X |
| 3,769,809 | 11/1973 | Robinson et al. | 62/354 X |
| 3,822,566 | 7/1974 | Lowi, Jr. | 62/240 X |
| 3,877,241 | 4/1975 | Wade | 62/344 X |
| 4,104,889 | 8/1978 | Hoenisch | 62/344 X |
| 4,249,388 | 2/1981 | Burns | 62/330 X |
| 4,433,559 | 2/1984 | Spinner | 62/354 |
| 4,525,073 | 6/1985 | Spinner | 62/354 |
| 4,574,593 | 3/1986 | Nelson | 62/354 |
| 4,576,016 | 3/1986 | Nelson | 62/354 |

FOREIGN PATENT DOCUMENTS

| | | | |
|---|---|---|---|
| 2121942 | 1/1984 | United Kingdom | 62/498 |

*Primary Examiner*—William E. Topolcai
*Attorney, Agent, or Firm*—M. K. Silverman

[57] ABSTRACT

The invention relates to a marinecraft refrigeration and delivery ice product system having means for the delivery of ice product to remote vertical and horizontal locations in the marinecraft.

10 Claims, 2 Drawing Sheets

MARINE ICE MAKING AND DELIVERY SYSTEM

BACKGROUND OF THE INVENTION

Ice making systems for use aboard boats, ships, and the like, have been long known and are reflected in such patents as U.S. Pat. No. 4,433,559 (1984) and No. 4,525,073 (1985), both to Spinner, entitled Ice Making Apparatus; and U.S. Pat. Nos. 4,574,593 (1986) and No. 4,576,016 (1986), both to Nelson, entitled Ice Making Apparatus. Products of the King Seely Thermos Company are similarly directed to ice making apparatus for use aboard ships, boats and the like, including means for dropping ice product output to lower levels within a boat.

A problem which has been recognized by boatsman and the like has been that of transporting ice flake, cubes, or other ice products formed by systems such as those referenced above, from outside of the marinecraft to various levels of the craft separated in both vertical height and horizontal distance from the location of the ice making apparatus. In such situations, it is necessary for a member of the crew to physically carry the location of the ice making apparatus to one or more remote locations within the marinecraft at which such ice product is to be used.

This requirement for manual delivery of the ice product from the location of the ice making apparatus to a remote area of the marinecraft has resulted in lost time and decreased crew efficiency.

It is a response to this problem, as it manifests itself in both pleasure marine applications and commercial marine applications, that the present invention is directed.

SUMMARY OF THE INVENTION

This invention relates to the use of a refrigeration circuit characterized by a raw water input for condenser cooling, a raw water output, a fresh water input, and an extruded ice product output from an ice product producing assembly that is a part of the refrigeration circuit. The refrigeration circuit is generally positioned upon the engine deck of the marinecraft. At the ice product output of the ice producing apparatus there is provided a flexible conduit having a length proportioned to remote sites at upper decks of the marinecraft at which use of the ice product is necessary. At the output of said ice product carrying conduit there is provided a ice product storage chamber having a thermostat at a vertical level of said chamber corresponding to the amount of ice product which the chamber is to hold when full. Said thermostat is a part of an electrical control circuit in which the compressor of the refrigeration circuit and the motor drive to said ice product making apparatus is turned-off when the level of ice product in said ice product storage chamber has reached a desired level. The ice product may be delivered at locations separated by horizontal distances of at least 30 feet from the product making assembly and at least five vertical feet thereabove.

It is, accordingly, an object of the present invention to provide a method and structure for retrofitting an existing marine ice making apparatus to provide an ice product output at locations both horizontally and vertically remote from the basic refrigeration circuit.

It is another object of the present invention to provide a marine refrigeration system having a water cooled condenser, and capable of providing fresh water ice output at locations remote therefrom.

A further object of the invention to provide a marine refrigeration and ice making system of improved efficiency and convenience of use.

It is a yet further object of the invention to provide a marine ice making system which will provide an ice product output at upper levels of a marinecraft notwithstanding the location of the refrigeration circuit and freezer assembly at the engine deck level.

The above and yet other object and advantages of the present invention will become apparent from the hereinafter set forth Detailed Description of the Invention, the Drawings, and claims appended herewith.

DETAILED DESCRIPTION OF THE INVENTION

Figure 1:
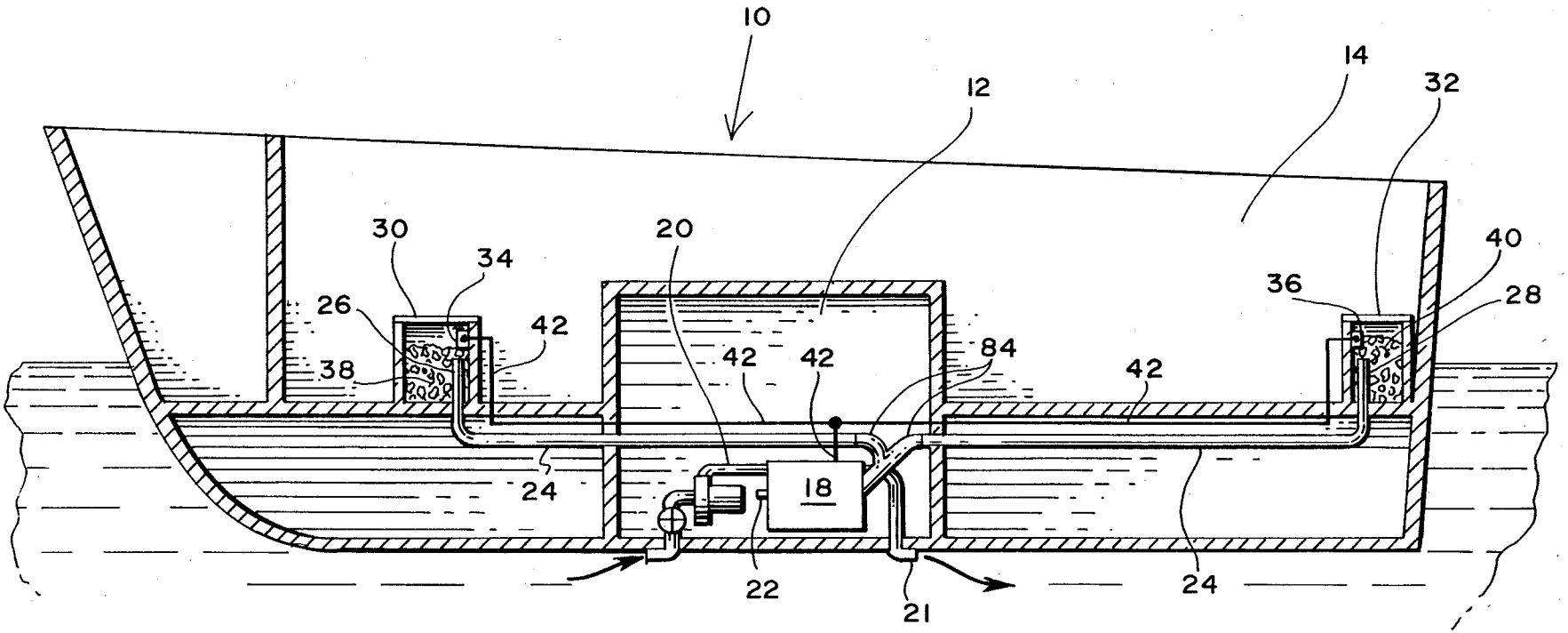
FIG. 1 is a longitudinal schematic view showing the location of the inventive system with reference to a marinecraft.

With reference to the schematic view of FIG. 1, there is shown a cross-sectional profile of a marinecraft 10 having an engine level deck 12, a passenger deck 14, and a railing 16. Further shown in the schematic view of FIG. 1 is a refrigeration circuit 18 having an ice product making assembly 62. (See FIG. 2). Inputs to said refrigeration circuit are pumped raw water input 20, a fresh water supply line 22, an electrical signal line 42 (more fully described below). The outputs of the circuit 18 are raw water output 21 and ice product at outlet 84.

Attached to said output 84 of the ice product making assembly 62 of refrigeration circuit 18 is a flexible conduit 24 having outlets 26 and 28 which feed into ice product storage chambers 30 and 32 respectively. As may be noted, ice product storage chamber 30 is located at the galley deck level 13 while ice product storage chamber 32 is located on the passenger deck 14. The vertical distance between passenger and engine decks is typically at least 5 feet. Further, a typical horizontal distance between chamber 32 and refrigeration circuit 18 would be about 30 feet.

Storage chambers 30 and 32 are provided with thermostats 34 and 36 respectively, the function of which is to sense when the level of ice 38 and 40 respectively approaches the physical location of the thermostat within their respective chambers. Accordingly, the function of the thermostats is to sense the amount of heat (or the absence thereof) at the skin of the thermostat. As such, thermostats 34 and 36 operate as switches which generate an "open circuit" input signal along electrical line 42, causing both compressor 68 and ice making apparatus 62 (both later described below) to turn-off when the level of ice in either were both chambers 30 or 32 has reached a desired level.

Figure 2:
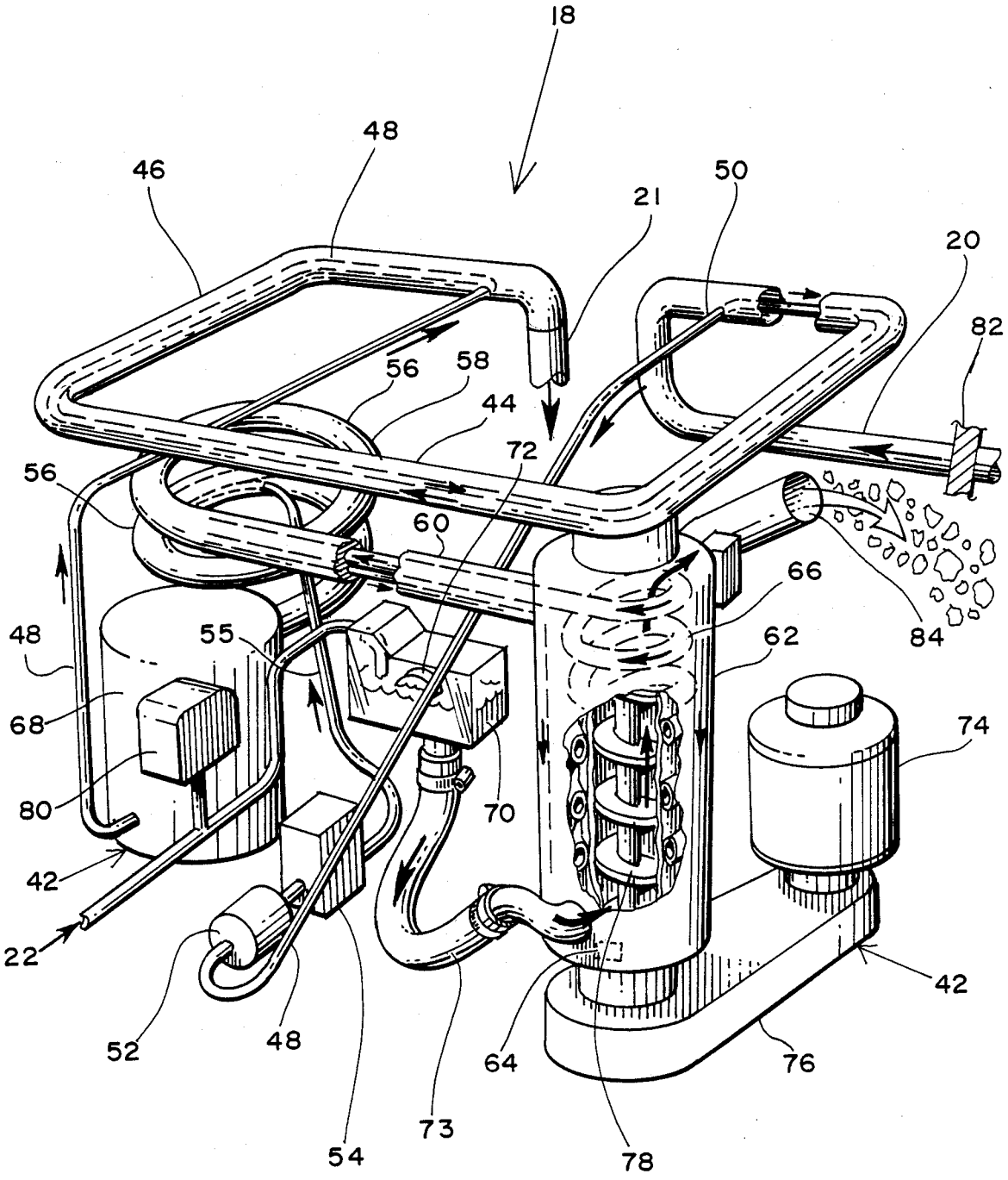
FIG. 2 is a schematic perspective view of the refrigeration circuit and associated ice product making apparatus, including the water and electrical inputs thereto.

With reference to the perspective view of FIG. 2, the refrigeration circuit 18 is seen to include said raw water input 20, a water cooled condenser 44 which includes an outer annular water line 46 and an inner refrigerant line 48. Said water line 46 exits from the condenser 44 and the marinecraft through outlet 21. As may be noted, at point 50 refrigerant line 48 of condenser 44 passes downward into drier/filter 52, to refrigerant flow control solenoid 54, and upwardly thru capillary tube 55 which becomes an outer annular refrigeration line 56 of compressor coils 58. Accordingly, it is to be noted that, within said compressor coils 58, liquid refrigerant passes upwardly along the outer annular line 56 until reaching dual line horizontal freezer input/output pipe 60 of the freezer assembly 62. Within said horizontal pipe 60 the cool liquid refrigerant moves along the outer annular line thereof towards ice maker assembly 62 and, after entering assembly 62, moves annularly downwardly (see downwardly pointing arrows) within assembly 62, to thusly chill the entire ice making assembly. The liquid refrigerant will accumulate in a lower region 64 of freezer 62 and, therefrom, work upwardly, as noted by upwardly pointing arrows, into freezer coils 66. Therefrom, the then gaseous refrigerant will move to the left through the center line of horizontal line 60 and down the center line of compressor coils 58 until reaching compressor 68. Warm liquid refrigerant will exit compressor 68 and move upwardly into the above described water cooled condenser 44 such that cold liquid refrigerant will exit the condenser at point 50 and, as above noted, will be fed through filter/dryer 52, solenoid 54, and upwardly into the outer annular line of horizontal line 60.

A fresh water input of the system in FIG. 2 is shown at 22 which, therefrom, feeds into fresh water reservoir 70 which includes therein a float 72, the purpose of which is to assure that a sufficient amount of fresh water is at all times supplied from fresh water line 22. From reservoir 70, fresh water enters the ice making assembly 62 through line 73. Also shown in FIG. 2 is an ice maker drive motor 74 and an associated gearbox 76 which in turn operates an ice extruding auger 78 which operates in accordance with long established ice making technology as is referenced in the Background of the Invention above. The extruding auger advances the ice and forcing ice out of outlet 84 subject to considerable force.

Also shown in FIG. 2 is a water pressure valve 80, the function of which is to preclude the operation of the refrigeration circuit when there is not sufficient fresh water pressure within line 22, thereby avoiding potential damage to the ice making assembly 62.

The presence of the said solenoid 54 assures that refrigerant will not flow within the refrigerant line 48 when the refrigeration circuit 18 is turned off. If refrigerant is permitted to flow in line 48 when the system is not operating, the result will be acquisition of heat by the refrigerant with a resultant expansion of the refrigerant within the refrigerant line 48 and within the ice making assembly 62, this often being the cause of damage within prior art refrigeration circuits.

Further, the inventive system also provides for a delay timer 82 (See FIG. 2), the function of which is to assure that water will be circulating within water cooled condenser 44 for a number of minutes before compressor 68 is turned on. This represents an important safety feature which can avoid potential heating and destruction of compressor 68.

Also shown in both figures are said electrical signal inputs 42 to compressor 68 and freezer gear drive 76, which, as above noted, cause both the ice making assembly 62 and the compressor 68 to stop operating when thermostat 34 and/or 36 show that the ice product storage chambers are filled to a desired level of ice product.

Accordingly, the present system incoporates a number of safety and convenience features. Further, the above system takes advantage of the naturally occurring low. temperature of the ambient water to operate the water cooled condenser 44.

The invention also represents a discovery that auger-operated ice making systems of the type discussed in the Background of the Invention above are capable of providing sufficient input force at conduit coupling 84 to move the mass of a long row of ice product to an eventual output some thirty feet of horizontal distance away and at least some five feet of vertical distance above the ice making assembly. This discovery is contra to prior teaching and opinion of those skilled in the art and, as well, meets a long felt need on the part of fisherman wishing to keep fresh fish in storage areas at the deck level. The system also meets the need for multiple ice product storage chambers, such as said chambers 30 and 32 at various areas of the craft, both at remote horizontal locations and at upper levels thereof.

Accordingly, the effect of the present invention is to provide a remote ice product dispensing system employing refrigeration and ice making technology heretofore believed to be incapable of such remote delivery. As such, the present invention may be considered both in terms of an inventive system an inventive use of a known system, i.e., of the refrigeration circuit 18 described above.

Accordingly, while there has been shown and described the preferred embodiment of the present invention, it is to be appreciated that the invention may be embodied otherwise than is herein specifically shown and described, and that within said embodiment, certain changes may be made in the detail thereof without departing from the principles of this invention within the scope of the claims appended herewith.

Having thus described our invention, what we claim as new, useful and non-obvious and, accordingly, secure by Letters Patent of the United States is:

1. A potable fresh water ice making and delivery system for marine use, the system comprising:

(a) a refrigeration circuit having an inlet supply of potable fresh water, said circuit located on the engine deck of a marine craft, the refrigeration circuit including an ice making assembly having a rotating auger-like extruder having a positive force mechanical ice unit output which is advanced and forced out of an outlet of said ice making assembly, said refrigeration circuit further including a water cooled condenser in which water for the operation thereof is drawn from ambient water about the marine craft;

(b) a flexible conduit coupled to said output of said assembly, said conduit having length sufficient to reach upper levels of the marine craft and to reach horizontally remote locations from said refrigeration circuit, said flexible conduit, in combination with said extruder of said ice making assembly, defining a transport means for said ice unit in which, within said conduit, there is slideably advanced a column of said ice units in which said column is powered by said ice unit output of said extruder and in which said output of ice units of said extruder are in dynamic positive thrust contact with said column of ice units within said conduit; and (c) storage chambers located at outputs of said flexible conduit for accumulation and storage of potable ice products advanced out of said outlets by said dynamic positive thrust contact of said output of said extruder and movement of said column of ice units effected by said rotated extruder of the ice making assembly, whereby the output of the ice making assembly is effectively transported to desired locations within the marine craft remote from said refrigeration circuit.

2. The system as recited in claim 1, further comprising:

a thermostat placed within each remotely located storage chamber at a vertical level within said chamber corresponding to a desired level of ice product to be received from the outlet of said flexible conduit.

3. The system as recited in claim 2, further comprising: electrical feedback means connecting said thermostat to said refrigeration circuit to thereby inactivate said freezer ice making assembly and compressor of said refrigeration circuit when the level of ice product within said storage chambers has achieved said desired level.

4. The system as recited in claim 3, further comprising: a delay timer for controlling said compressor to delay activation thereof until water has circulated for a predetermined period of time within said water cooled condenser, thereby ensuring proper cooling of the refrigeration circuit before the compressor is activated.

5. The system as recited in claim 3, further comprising:

a water pressure switch including a fresh water input to the ice making assembly to inactivate said assembly when a sufficient level of fresh water is not available at a reservoir of such assembly.

6. The system as recited in claim 3, further comprising:

solenoid means to prevent the flow of refrigerant within said refrigeration circuit when said compressor is not actuated.

7. The system as recited in claim 4, further comprising:

a water pressure valve including a fresh water input to the ice making assembly to inactivate said assembly when a sufficient level of fresh water is not available at a reservoir of said assembly.

8. The system as recited in claim 6, further comprising: a water pressure valve including a fresh water input to the reservoir ice making assembly to inactivate said assembly when a sufficient level of fresh water is not available at the reservoir of said assembly.

9. The system as recited in claim 4, further comprising:

solenoid means to prevent the flow of refrigerant within said refrigeration circuit when said compressor is not actuated.

10. The system as recited in claim 5, further comprising: solenoid means to prevent the flow of refrigerant within said refrigeration circuit when said compressor is not actuated.

* * * * *

US004922724C1

(12) REEXAMINATION CERTIFICATE (4694th)

United States Patent

Grayson et al.

(10) Number: US 4,922,724 C1

(45) Certificate Issued: Dec. 31, 2002

(54) MARINE ICE MAKING AND DELIVERY SYSTEM

(75) Inventors: William Grayson, 9045 Hawthorne Ave., Surfside, FL (US) 33154; Melvin E. Strahosky, Miami, FL (US)

(73) Assignee: William Grayson, Surfside, FL (US)

Reexamination Request:
No. 90/006,274, Apr. 29, 2002

Reexamination Certificate for:

| | |
|---|---|
| Patent No.: | **4,922,724** |
| Issued: | **May 8, 1990** |
| Appl. No.: | **07/322,187** |
| Filed: | **Mar. 13, 1989** |

(51) Int. Cl.[7] ..... F25C 1/00; F25C 5/18; B63B 25/26

(52) U.S. Cl. ..... 62/135; 62/354; 62/201; 62/240; 62/330; 62/344; 366/323

(58) Field of Search ..... 62/135, 201, 240, 62/320, 354; 366/323, 324

(56) References Cited

U.S. PATENT DOCUMENTS

| | | | | | |
|---|---|---|---|---|---|
| 2,057,101 | A | * | 10/1936 | Kagi | 62/201 X |
| 2,748,572 | A | * | 6/1956 | Parcaro | 62/506 X |
| 3,371,505 | A | * | 3/1968 | Raver et al. | 62/320 |
| 3,630,045 | A | * | 12/1971 | Lunde | 62/320 |
| 3,822,566 | A | * | 7/1974 | Lowi, Jr. | 62/240 X |
| 4,433,559 | A | * | 2/1984 | Spinner | 62/354 |
| 4,525,073 | A | * | 6/1985 | Spinner | 62/354 |
| 4,533,310 | A | * | 8/1985 | Spinner | 62/354 |

FOREIGN PATENT DOCUMENTS

| | | | | | |
|---|---|---|---|---|---|
| GB | 2121942 | A | * | 1/1984 | 62/498 |

OTHER PUBLICATIONS

Scotsman MF400 Service Manual, May 1991.*

Scotsman MF700 Service Manual, Oct. 1987.*

* cited by examiner

*Primary Examiner*—Chen-Wen Jiang

(57) ABSTRACT

The invention relates to a marinecraft refrigeration and delivery ice product system having means for the delivery of ice product to remote vertical and horizontal locations in the marinecraft.

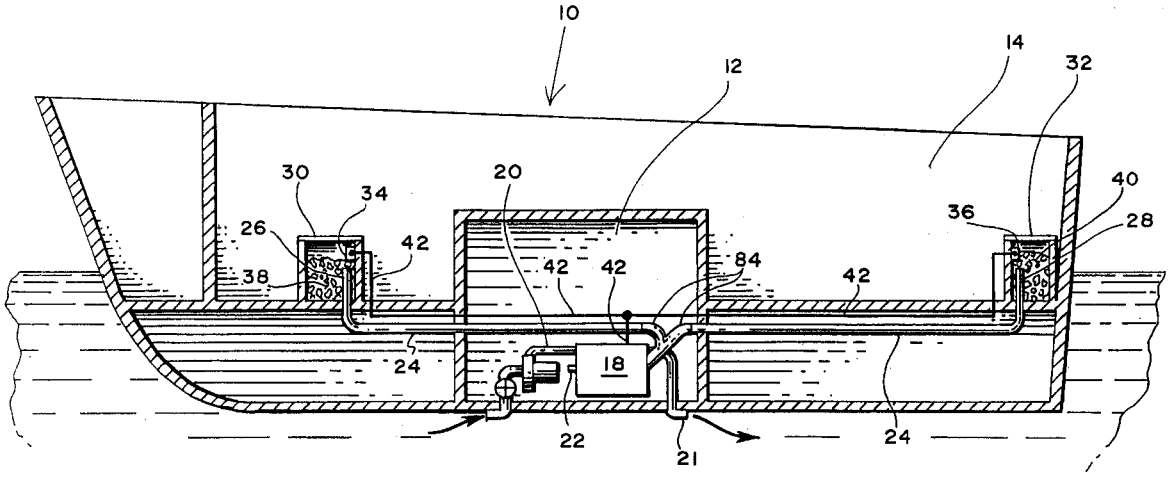

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–10 is confirmed.

* * * * *